US012130090B2

(12) United States Patent
Ruiz et al.

(10) Patent No.: US 12,130,090 B2
(45) **Date of Patent: *Oct. 29, 2024**

(54) HEAT EXCHANGER WITH RADIALLY CONVERGING MANIFOLD

(71) Applicant: Hamilton Sundstrand Corporation, Charlotte, NC (US)

(72) Inventors: Gabriel Ruiz, Granby, CT (US); Ahmet T. Becene, West Simsbury, CT (US); Thomas J. Ocken, Des Moines, IA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 256 days.

This patent is subject to a terminal disclaimer.

(21) Appl. No.: 17/688,422

(22) Filed: Mar. 7, 2022

(65) Prior Publication Data

US 2022/0187030 A1 Jun. 16, 2022

Related U.S. Application Data

(63) Continuation of application No. 16/563,026, filed on Sep. 6, 2019, now Pat. No. 11,268,770.

(51) Int. Cl.
*F28F 1/02* (2006.01)

(52) U.S. Cl.
CPC ..... *F28F 1/022* (2013.01); *F28F 2210/02* (2013.01); *F28F 2255/00* (2013.01)

(58) Field of Classification Search
CPC .... F28F 1/022; F28F 2210/02; F28F 2255/00; F28F 9/0275; F16L 47/32
See application file for complete search history.

(56) References Cited

U.S. PATENT DOCUMENTS 266,160 A 10/1882 Johnson
1,655,086 A 1/1928 Blanding
1,768,222 A 6/1930 Robert
(Continued)

FOREIGN PATENT DOCUMENTS

DE 202019102083 U1 4/2019
EP 0074570 A2 3/1983
(Continued)

OTHER PUBLICATIONS

Communication Pursuant to Article 94(3) EPC for EP Application No. 19215931.7, dated Oct. 27, 2022, 5 pages.
(Continued)

*Primary Examiner* — Tho V Duong
(74) *Attorney, Agent, or Firm* — Kinney & Lange, P.A.

(57) ABSTRACT

A heat exchanger manifold configured to receive or discharge a first fluid includes a primary fluid channel and a plurality of secondary fluid channels. The primary fluid channel includes a fluid port and a first branched region distal to the fluid port. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end.

20 Claims, 3 Drawing Sheets

(56) References Cited

U.S. PATENT DOCUMENTS

| | | | | |
|---|---|---|---|---|
| 1,913,573 | A | 6/1933 | Turner | |
| 2,693,346 | A | 11/1954 | Holger | |
| 2,734,224 | A | 2/1956 | Winstead | |
| 2,798,361 | A | 7/1957 | Hiersch | |
| 3,205,939 | A | 9/1965 | Andre | |
| 3,212,570 | A | 10/1965 | Holman | |
| 3,240,675 | A | 3/1966 | Max | |
| 4,058,161 | A | 11/1977 | Trepaud | |
| 4,066,121 | A | 1/1978 | Kleine et al. | |
| 4,451,960 | A | 6/1984 | Molitor | |
| 4,570,703 | A | 2/1986 | Ringsmuth et al. | |
| 5,213,156 | A | 5/1993 | Eriksson | |
| 5,388,635 | A | 2/1995 | Gruber et al. | |
| 5,551,504 | A | 9/1996 | Zifferer | |
| 6,296,020 | B1 | 10/2001 | McNeely et al. | |
| 6,679,083 | B1 | 1/2004 | Erickson | |
| 6,688,381 | B2 | 2/2004 | Pence et al. | |
| 7,021,608 | B2 | 4/2006 | Laevemann et al. | |
| 7,240,723 | B2 | 7/2007 | Wu et al. | |
| 8,241,239 | B2 | 8/2012 | Solomon et al. | |
| 8,528,628 | B2 | 9/2013 | Robinson | |
| 9,134,072 | B2 | 9/2015 | Roisin et al. | |
| 9,279,621 | B2 | 3/2016 | Seybold et al. | |
| 9,541,331 | B2 | 1/2017 | Nagurny et al. | |
| 9,605,912 | B2 | 3/2017 | Neal et al. | |
| 9,656,212 | B2 | 5/2017 | Dibiasio et al. | |
| 9,964,077 | B2 | 5/2018 | Neal et al. | |
| 9,976,815 | B1 | 5/2018 | Roper et al. | |
| 10,048,019 | B2 | 8/2018 | Karlen et al. | |
| 10,088,250 | B2 | 10/2018 | Turney | |
| 10,267,515 | B2 | 4/2019 | Adriany et al. | |
| 10,684,080 | B2 | 6/2020 | Moore et al. | |
| 11,209,222 | B1 | 12/2021 | Colson | |
| 2003/0039169 | A1 | 2/2003 | Ehrfeld et al. | |
| 2004/0195708 | A1 | 10/2004 | Lavemann et al. | |
| 2008/0190586 | A1 | 8/2008 | Robinson | |
| 2009/0269837 | A1 | 10/2009 | Shevkoplyas et al. | |
| 2009/0274549 | A1* | 11/2009 | Mitchell | F01D 5/186 415/115 |
| 2009/0316972 | A1 | 12/2009 | Borenstein et al. | |
| 2010/0096115 | A1 | 4/2010 | Erickson | |
| 2010/0297535 | A1 | 11/2010 | Das et al. | |
| 2012/0125560 | A1* | 5/2012 | McKeown | F16L 47/32 165/45 |
| 2013/0206374 | A1* | 8/2013 | Roisin | F28D 7/0041 165/165 |
| 2014/0262136 | A1 | 9/2014 | Jensen | |
| 2015/0140190 | A1 | 5/2015 | Cully et al. | |
| 2016/0116218 | A1 | 4/2016 | Shedd et al. | |
| 2017/0030651 | A1* | 2/2017 | Rock, Jr. | F28F 1/06 |
| 2017/0089643 | A1* | 3/2017 | Arafat | F28D 9/0037 |
| 2017/0191762 | A1 | 7/2017 | Duesler et al. | |
| 2017/0205149 | A1 | 7/2017 | Herring et al. | |
| 2017/0248372 | A1 | 8/2017 | Erno et al. | |
| 2017/0328644 | A1 | 11/2017 | Takahashi | |
| 2018/0038654 | A1 | 2/2018 | Popp et al. | |
| 2018/0051934 | A1 | 2/2018 | Wentland et al. | |
| 2018/0100703 | A1 | 4/2018 | Beaver et al. | |
| 2018/0100704 | A1 | 4/2018 | Lewandowski et al. | |
| 2018/0106550 | A1 | 4/2018 | Nelson et al. | |
| 2018/0266770 | A1* | 9/2018 | Wagner | F28F 7/02 |
| 2018/0283794 | A1 | 10/2018 | Cerny et al. | |
| 2018/0283795 | A1 | 10/2018 | Cerny et al. | |
| 2019/0024988 | A1* | 1/2019 | Wilson | F28F 9/0214 |
| 2019/0024989 | A1 | 1/2019 | Wilson et al. | |
| 2019/0086154 | A1 | 3/2019 | Adriany et al. | |
| 2019/0366290 | A1 | 12/2019 | Hofmann et al. | |
| 2020/0041212 | A1* | 2/2020 | Palmer | F28F 1/025 |
| 2020/0263928 | A1 | 8/2020 | Joseph et al. | |
| 2020/0284516 | A1 | 9/2020 | Becene et al. | |
| 2020/0284517 | A1 | 9/2020 | Becene et al. | |
| 2020/0284518 | A1 | 9/2020 | Becene et al. | |
| 2020/0284519 | A1 | 9/2020 | Becene et al. | |
| 2020/0284531 | A1 | 9/2020 | Maynard et al. | |
| 2020/0284532 | A1 | 9/2020 | Becene et al. | |
| 2020/0318910 | A1 | 10/2020 | Ruiz et al. | |
| 2020/0318913 | A1 | 10/2020 | Ruiz et al. | |
| 2021/0071964 | A1 | 3/2021 | Ruiz et al. | |

FOREIGN PATENT DOCUMENTS

| | | | |
|---|---|---|---|
| EP | 3124906 | A1 | 2/2017 |
| EP | 3410054 | A1 | 12/2018 |
| FR | 453494 | A | 6/1913 |
| GB | 588520 | A | 5/1947 |
| JP | 2006322643 | A | 11/2006 |
| WO | 2010138061 | A1 | 12/2010 |
| WO | 2017052798 | A1 | 3/2017 |
| WO | 2018154063 | A1 | 8/2018 |
| WO | 2018182808 | A1 | 10/2018 |
| WO | 2018191787 | A1 | 10/2018 |

OTHER PUBLICATIONS

Communication Pursuant to Article 94(3) EPC for EP Application No. 19216146.1, dated Oct. 28, 2022, 5 pages.

Communication Pursuant to Article 94(3) EPC for EP Application No. 19216221.2, dated Oct. 27, 2021, 6 pages.

Extended European Search Report for EP Application No. 19215931.7, dated Jul. 28, 2020, 8 pages.

Extended European Search Report for EP Application No. 19216146.1, dated Jul. 22, 2020, 8 pages.

Extended European Search Report for EP Application No. 19216221.2, dated Jul. 28, 2020, 7 pages.

Extended European Search Report for EP Application No. 19216295.6, dated Jul. 22, 2020, 7 pages.

Extended European Search Report for European Patent Application No. 19213258.7, dated May 8, 2020, 8 pages.

L. Luo et al., "Constructal Approach and Multi-Scale Components", from Applied Thermal Engineering 27 (2007), pp. 1708-1714.

L. Luo et al., Experimental Study of Constructal Distributor for Flow Equidistribution in a Mini Crossflow Heat Exchanger (MCHE), from Chemical Engineering and Processing 47, (2008) pp. 229-236.

L. Luo et al., "Integration of Constructal Distributors to a Mini Crossflow Heat Exchanger and Their Assembly Configuration Optimization", from Chemical Engineering Science 62, (2007) pp. 3605-3619.

Z.Fan, et al., "Numerical Investigation of Constructal Distributors with Different Configurations", from Chinese Journal of Chemical Engineering, 17(1), (2009) pp. 175-178.

"Extended European Search Report", Extended European Search Report for European Patent Application No. 2117619.7, dated Nov. 9, 2021, 8 pages.

* cited by examiner

HEAT EXCHANGER WITH RADIALLY CONVERGING MANIFOLD

CROSS-REFERENCE TO RELATED APPLICATION(S)

This application is a continuation of U.S. application Ser. No. 16/563,026 filed Sep. 6, 2019, entitled "HEAT EXCHANGER WITH RADIALLY CONVERGING MANIFOLD" by Gabriel Ruiz, Ahmet T. Becene, and Thomas J. Ocken.

BACKGROUND

This disclosure relates generally to heat exchangers, and more specifically to manifolds for heat exchangers with fractal geometry.

Heat exchangers are well known in many industries for providing compact, low-weight, and highly-effective means of exchanging heat from a hot fluid to a cold fluid. Heat exchangers can operate in high temperature environments, such as in modern aircraft engines. Heat exchangers that operate at elevated temperatures can have reduced service lives due to high thermal stress. Thermal stress can be caused by uneven temperature distribution within the heat exchanger or with abutting components, component stiffness and geometry discontinuity, and/or other material properties of the heat exchanger. The interface between an inlet/outlet manifold and the core of a heat exchanger can be subject to the highest thermal stress and the shortest service life.

Additive manufacturing techniques can be utilized to manufacture heat exchangers layer by layer to obtain a variety of complex geometries. Depending on the geometry of the heat exchanger, additional internal or external support structures can be necessary during additive manufacturing to reinforce a build. Often, removal of internal support structures from a heat exchanger is difficult or even impossible, thereby limiting the geometries that can be built successfully.

SUMMARY

In one example, a heat exchanger manifold configured to receive or discharge a first fluid includes a primary fluid channel and a plurality of secondary fluid channels. The primary fluid channel includes a fluid port and a first branched region distal to the fluid port. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end.

In another example, a heat exchanger includes an inlet manifold configured to receive a first fluid, a core in fluid communication with the inlet manifold, and an outlet manifold in fluid communication with the core. The inlet manifold includes a primary fluid channel and a plurality of secondary fluid channels. The primary fluid channel includes a fluid inlet and a first branched region distal to the fluid inlet. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end. The outlet manifold similarly includes a primary fluid channel and a plurality of secondary fluid channels. The primary fluid channel includes a fluid inlet and a first branched region distal to the fluid inlet. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end.

In another example, a method includes forming a core for a heat exchanger and additively manufacturing a first manifold for the heat exchanger. Additively manufacturing the first manifold includes additively building a branching tubular network. The network includes a primary fluid channel connected to a first branched region, a plurality of secondary fluid channels fluidly connected to the primary fluid channel at the first branched region, a second branched region, and a plurality of tertiary fluid channels fluidly connected to each of the plurality of secondary channels at the second branched region. Each of the plurality of secondary fluid channels includes a first end and a second end opposite the first end, wherein each of the plurality of secondary fluid channels extends radially from the first branched region at the first end and has an equal length from a center of the first branched region to the second end. The second branched region is adjacent to the second end of each of the plurality of secondary fluid channels. The primary fluid channel is symmetric about a first axis, the plurality of secondary fluid channels are symmetric about a second axis, and the second axis forms a non-zero angle with the first axis, such that each of the plurality of secondary fluid channels forms a build angle of 45 degrees or greater with a horizontal plane.

DETAILED DESCRIPTION

A heat exchanger with a radially converging manifold is disclosed herein. The heat exchanger includes branched tubular inlet and outlet manifolds with fractal branching patterns and radially converging geometry. The heat exchanger manifolds can be additively manufactured at an optimal build angle to reduce internal structural support requirements.

Figure 1:
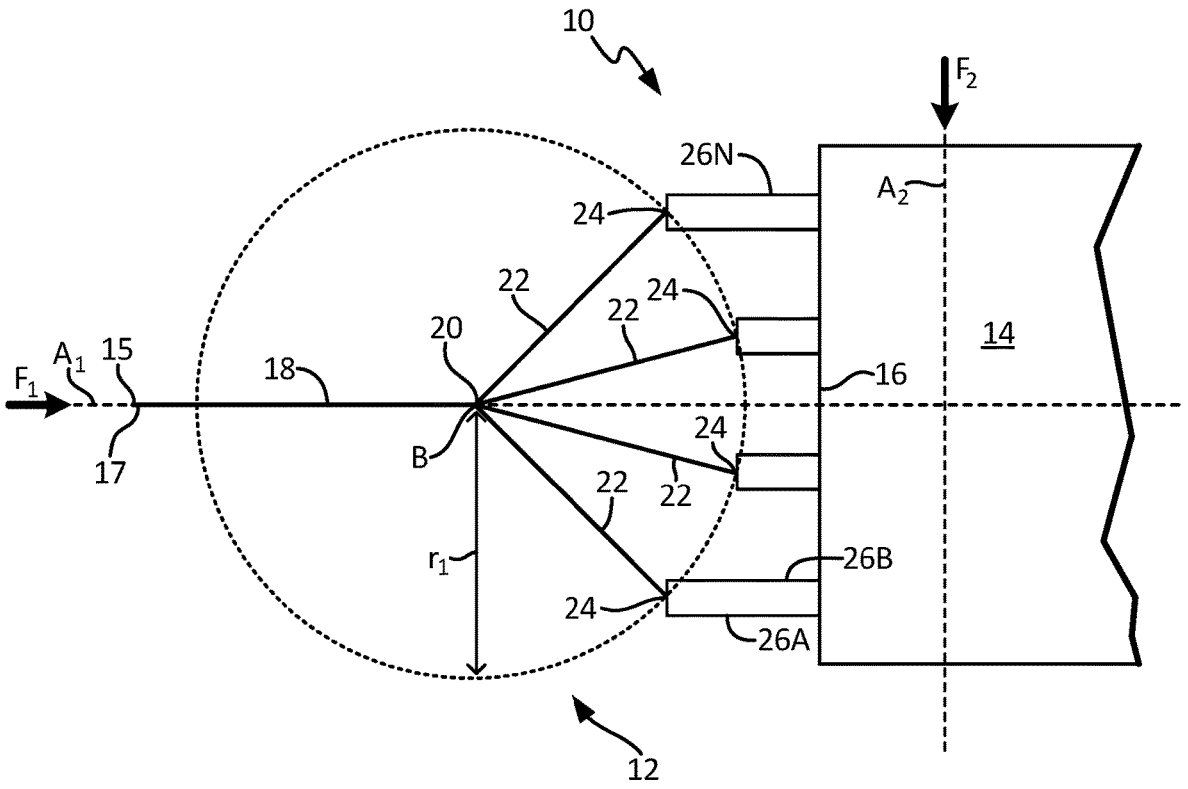
FIG. 1 is a schematic view of a heat exchanger showing a manifold with radially converging geometry.
Figure 2:
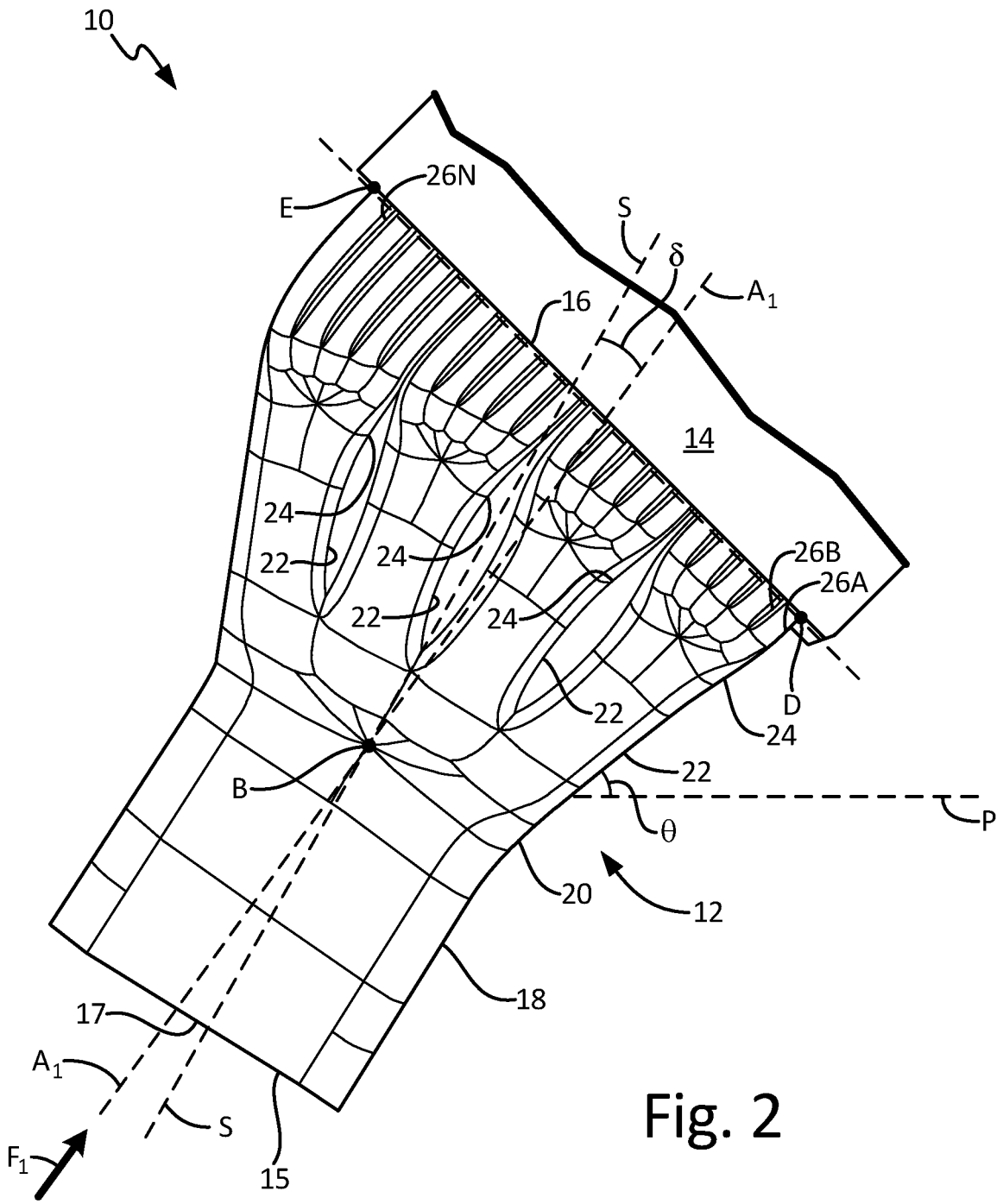
FIG. 2 is a perspective side view of an embodiment of the heat exchanger of FIG. 1 showing a manifold with radially converging and fractal geometry and secondary fluid channels with a shifted centerline.

For purposes of clarity and ease of discussion, FIGS. 1 and 2 will be described together. FIG. 1 is a schematic view of heat exchanger 10 showing manifold 12 with radially converging geometry. FIG. 2 shows a perspective side view of an embodiment of heat exchanger 10 with radially converging geometry and with shifted centerline S. Heat exchanger 10 includes manifold 12 fluidly connected to core 14. Manifold 12 includes first end 15, second end 16, fluid port 17, primary fluid channel 18, first branched region 20, secondary fluid channels 22, second branched regions 24, and tertiary fluid channels 26A-26N ("N" is used herein as an arbitrary integer). Heat exchanger 10 receives first fluid $F_1$ along first axis $A_1$ and interacts thermally with second fluid $F_2$ along second axis $A_2$. Center B of first branched region 20 illustrates a point at the center of a representative three-dimensional spherical space corresponding to first branched region 20 and second branched regions 24. The representative spherical space can be defined by radius $r_1$ and is represented by a dashed circle in FIG. 1. However, it should be understood that the actual three-dimensional shape of first branched region 20 and secondary fluid channels 22 need not be spherical.

Fluid port 17 forms an opening into the fluid system of heat exchanger 10. In the examples of FIGS. 1 and 2, fluid port 17 is configured as an opening into primary fluid channel 18 on first end 15 of manifold 12. Primary fluid channel 18 forms a first section of manifold 12. Primary fluid channel 18 extends along first axis $A_1$ between fluid port 17 and downstream first branched region 20. First branched region 20 forms an end of primary fluid channel 18 distal to fluid port 17. Secondary fluid channels 22 are fluidly connected to primary fluid channel 18 at first branched region 20. Though the examples of FIGS. 1 and 2 show first branched region 20 branching into four secondary fluid channels 22, it should be understood that in other examples, alternate configurations are possible, including more or fewer secondary fluid channels 22 extending from first branched region 20. Furthermore, though manifold 12 is represented in FIG. 2 as a substantially planar structure, secondary fluid channels 22 can also extend along additional parallel planes to form a layered structure.

Each secondary fluid channel 22 extends between first branched region 20 and downstream second branched region 24. Each secondary fluid channel 22 can form a relatively straight path between first branched region 20 and second branched regions 24. Secondary fluid channels 22 are radially converging such that a central longitudinal axis can be drawn through each of secondary fluid channels 22 to converge at center B. Additionally, secondary fluid channels 22 have radially equivalent lengths such that the length of each secondary fluid channel 22, as measured from center B to second branched region 24, is equal to radius $r_1$. Thus, a cross-sectional circumference of the representative sphere with center B and radius $r_1$ (e.g., as represented by dashed circle in FIG. 1) includes points corresponding to each of second branched regions 24. In the exaggerated schematic example of FIG. 1, each secondary fluid channel 22 is shown spaced along a representative circular arc corresponding to radius $r_1$. It should be understood that the circumferential distance along an arc (i.e., length of the circular arc) between each secondary fluid channel 22 can be very small (e.g., one hundredth of a millimeter, one tenth of a millimeter, a millimeter, a centimeter, or other distances), such that each secondary fluid channel is directed substantially along first axis $A_1$.

At second branched regions 24, each secondary fluid channel 22 is fluidly connected to downstream tertiary fluid channels 26A-26N. Though the example of FIG. 1 shows each of second branched regions 24 branching into two of tertiary fluid channels 26A-26N, it should be understood that in other examples, alternate configurations are possible, including more or fewer tertiary fluid channels 26A-26N extending from second branched regions 24 (e.g., as shown in FIG. 2). In some examples, heat exchanger 10 can have a fractal geometry defining the branching relationship between secondary fluid channels 22 and tertiary fluid channels 26A-26N, such that the number of tertiary fluid channels 26A-26N at each second branched region 24 is equal to the total number of secondary fluid channels 22. In yet other examples, the number of tertiary fluid channels 26A-26N extending from different second branched regions 24 can be varied throughout manifold 12.

The configuration and fractal geometry of secondary fluid channels 22 and tertiary fluid channels 26A-26N is shown in greater detail in FIG. 2. Secondary fluid channels 22 extend from primary fluid channel 18 at first branched region 20. The arrangement of secondary fluid channels 22 can be symmetric about centerline S. Thus, centerline S can separate the plurality of secondary fluid channels 22 into an equal number of secondary fluid channels 22 on each side of centerline S. Centerline S is shifted with respect to first axis $A_1$, such that it can form non-zero first angle $\delta$ with first axis $A_1$. That is, manifold 12 can be asymmetrical about first axis $A_1$ in the region of secondary fluid channels 22 (though manifold 12 can be symmetrical about first axis $A_1$ in the region of primary fluid channel 18). Due to the non-zero angle $\delta$ of centerline S with first axis $A_1$, each of secondary fluid channels 22 can form an angle of 45 degrees or greater with representative horizontal plane P. As shown in the example of FIG. 2, one of secondary fluid channels 22 forms angle $\theta$ with horizontal plane P. Angle $\theta$ can be, for example, 45 degrees.

Though the example of FIG. 2 shows each of second branched regions 24 branching into five tertiary fluid channels 26A-26N, it should be understood that in other examples, alternate configurations are possible, including more or fewer tertiary fluid channels 26A-26N extending from second branched regions 24. For example, the number of tertiary fluid channels 26A-26N at each second branched region 24 can be equal to the total number of secondary fluid channels 22. In yet other examples, the number of tertiary fluid channels 26A-26N extending from different second branched regions 24 can be varied throughout manifold 12.

Tertiary fluid channels 26A-26N extend from second branched region 24 to interface C with core 14 at second end 16 of manifold 12. Each tertiary fluid channel 26A-26N can form a relatively straight path between second branched regions 24 and interface C. Interface C passes through a center (not indicated in FIG. 2) of each tertiary fluid channel 26A-26N. In the example shown in FIG. 2, interface C is angled such that it is not perpendicular to first axis $A_1$, and each of tertiary fluid channels 26A-26N extends a different length between second branched region 24 and core 14. In other examples, each of tertiary fluid channels 26A-26N can extend an equal length between second branched region 24 and core 14.

First point D of interface C can correspond to a first one of tertiary fluid channels 26A-26N (e.g., tertiary fluid channel 26A in FIG. 2). End point E of interface C can correspond to a final one of tertiary fluid channels 26A-26N (e.g., tertiary fluid channel 26N in FIG. 2). In the example of FIG. 2, tertiary fluid channels 26A-26N are generally configured in ascending order by length from first point D to end point E laterally along the interface with core 14. However, because the length of each tertiary fluid channel 26A-26N is dependent, in part, on the radial position of the corresponding second branched region 24 and the geometry of core 14, it should be understood that alternate embodiments of heat exchanger 10 can include alternate configurations of tertiary fluid channels 26A-26N such that tertiary fluid channels 26A-26N are not arranged in ascending/descending order, but are instead configured to extend any length between second branched regions 24 and core 14. For example, in alternate embodiments, interface C can form a curved line or an irregular interface with core 14 that is not defined by a line.

Second end 16 of manifold 12 forms an interface between manifold 12 and core 14. In the examples of FIGS. 1 and 2, core 14 is shown with a rectangular geometry, such as a plate-fin heat exchanger, but it should be understood that alternative embodiments can include other core types and/or geometries. Within manifold 12, each of primary fluid channel 18, secondary fluid channels 22, and tertiary fluid channels 26A-26N can be tubular in structure to facilitate fluid flow. Further, manifold 12 can be additively manufactured to achieve varied tubular dimensions (e.g., cross-sectional area, wall thicknesses, curvature, etc.), and can be mated with traditional core sections (e.g., plate-fin) or with more complex, additively manufactured core sections. Though the example of FIG. 2 illustrates heat exchanger 10 as including a single manifold 12 with second end 16, it should be understood that in other examples, heat exchanger 10 can include more than one manifold structure interfacing with core 14. Multiple manifold structures can be arranged in a substantially similar manner to manifold 12 to form multiple interface regions with core 14 that are each substantially similar to second end 16.

With continued reference to FIGS. 1 and 2, heat exchanger 10 is configured to permit the transfer of heat between first fluid $F_1$ and second fluid $F_2$. For example, a transfer of heat can be associated with the use of first fluid $F_1$ and/or second fluid $F_2$ for cooling and/or lubrication of components in a larger system, such as a gas turbine engine or aerospace system. First fluid $F_1$ and second fluid $F_2$ can be any type of fluid, including air, water, lubricant, fuel, or another fluid. Heat exchanger 10 is described herein as providing heat transfer from first fluid $F_1$ to second fluid $F_2$; therefore, first fluid $F_1$ is at a greater temperature than second fluid $F_2$ at the point where first fluid $F_1$ enters heat exchanger 10 (i.e., first fluid $F_1$ is a "hot" fluid and second fluid $F_2$ is a "cold" fluid). However, other configurations of heat exchanger 10 can include second fluid $F_2$ at a greater temperature than first fluid $F_1$ (and, thus, second fluid $F_2$ would be the "hot" fluid and first fluid $F_1$ would be the "cold" fluid).

In the example of FIG. 1, first fluid $F_1$ is shown flowing generally along first axis $A_1$ to enter heat exchanger 10 at fluid port 17. In another example, the direction of flow of first fluid $F_1$ can be reversed such that first fluid $F_1$ exits heat exchanger 10 at fluid port 17. Furthermore, heat exchanger 10 can be arranged to receive second fluid $F_2$ at core 14 along second axis $A_2$ perpendicular to axis $A_1$ (i.e., a cross-flow arrangement as shown in FIG. 1), or to receive second fluid $F_2$ along an axis parallel to axis $A_1$ (not shown in FIG. 1) in an opposite flow direction (i.e., a counter-flow arrangement).

Fluid port 17 of manifold 12 is configured to receive or discharge first fluid $F_1$ flowing along first axis $A_1$. First fluid $F_1$ entering manifold 12 at fluid port 17 is channeled through primary fluid channel 18 to first branched region 20. At first branched region 20, first fluid $F_1$ flows into secondary fluid channels 22. First branched region 20 and secondary fluid channels 22 are configured in a radially converging manner (as described above) such that first fluid $F_1$ has an equivalent fluid flow path (i.e., there is no "path of least resistance") through each of the plurality of secondary fluid channels 22. From first branched region 20, first fluid $F_1$ flows within secondary fluid channels 22 to reach second branched regions 24. At each second branched region 24, first fluid $F_1$ is channeled out from secondary fluid channel 22 into tertiary fluid channels 26A-26N. In the examples of FIGS. 1 and 2, first fluid $F_1$ flows directly from tertiary fluid channels 26A-26N into core 14. In alternative embodiments, manifold 12 can be configured to include additional levels of branching and intervening fluid channels fluidly connected downstream of tertiary fluid channels 26A-26N and upstream of core 14. Heat transfer between first fluid $F_1$ and second fluid $F_2$ can occur largely at core 14 of heat exchanger 10.

Manifold 12 and/or core 14 of heat exchanger 10 can be formed partially or entirely by additive manufacturing. For metal components (e.g., Inconel, aluminum, titanium, etc.) exemplary additive manufacturing processes include powder bed fusion techniques such as direct metal laser sintering (DMLS), laser net shape manufacturing (LNSM), electron beam manufacturing (EBM), to name a few, non-limiting examples. For polymer or plastic components, stereolithography (SLA) can be used. Additive manufacturing is particularly useful in obtaining unique geometries and for reducing the need for welds or other attachments (e.g., between a header and core). However, it should be understood that other suitable manufacturing processes can be used.

During an additive manufacturing process, heat exchanger 10, or manifold 12, or core 14 can be formed layer by layer. Each additively manufactured layer creates a new horizontal build plane to which a subsequent layer of heat exchanger 10 is fused. That is, the build plane for the additive manufacturing process remains horizontal but shifts vertically by defined increments (e.g., one micrometer, one hundredth of a millimeter, one tenth of a millimeter, a millimeter, or other distances) as manufacturing proceeds. The example of FIG. 2 shows heat exchanger 10 already fully manufactured. Thus, horizontal plane P in FIG. 2 is a representative horizontal plane corresponding to a previous build plane as heat exchanger 10 was manufactured. From the portion of heat exchanger 10 manufactured up to horizontal plane P, the example of FIG. 2 shows one of secondary fluid channels 22 was further manufactured at angle θ to horizontal plane P.

In general, the radially converging profile of manifold 12 retains the benefits of fractal geometry compared to traditional heat exchanger header configurations. Traditional heat exchanger headers, such as those with box-shaped manifolds, can have increased stress concentration at the interface between the manifold and the core, particularly at corners of the manifold where there is geometry discontinuity. The branching pattern of fractal heat exchanger manifolds, wherein each fluid channel is individually and directly connected to a passage in the core as shown in FIGS. 1 and 2, can reduce this geometry discontinuity. Furthermore, each fluid channel in a fractal heat exchanger manifold (e.g., manifold 12) behaves like a slim beam with low stiffness in transverse directions and reduced stiffness in horizontal directions due to the curved shape at each branched region. Thus, fractal heat exchanger manifolds have increased compliance (i.e., reduced stiffness) and experience less thermal stress compared to traditional heat exchanger header configurations.

Some complex heat exchangers or parts can require additional internal or external support structures during additive manufacturing to ensure structural integrity of the part. Internal support structures are not typically removed from a heat exchanger manifold after manufacture. Presence of internal support structures can cause increased resistance (i.e., pressure drop) within the manifold and, thereby, inefficient transfer of heat between first fluid $F_1$ and second fluid $F_2$, so it is beneficial to reduce the internal support requirements of a build. One option for reducing internal support requirements is to align the fluid channels of the heat exchanger manifold with respect to the particular build orientation. However, aligning these channels in typical fractal geometry configurations can create a path of least resistance for the fluid flowing through the heat exchanger, such that the fluid is biased to flow through the shortest path within the heat exchanger. A path of least resistance can cause a pressure drop in the fluid flow, and, thereby, decrease the efficiency of the heat exchanger.

The radially converging profile of manifold 12 provides for improved fluid flow through heat exchanger 10. Because each radially converging secondary fluid channel 22 has an equal length between center B of first branched region 20 and each second branched region 24, there is no path of least resistance for first fluid $F_1$ to take through heat exchanger 10. Thus, manifold 12 can reduce the pressure drop caused by aligning manifold 12 with respect to a build orientation.

Furthermore, the radially converging profile of manifold 12 and the shifted centerline S of secondary fluid channels 22, as described above with reference to FIG. 2, enable manifold 12 to be additively manufactured at an optimal build angle. For example, an optimal build angle for additive manufacturing of a heat exchanger manifold can be 45 degrees or greater to a horizontal build plane (e.g., horizontal plane P in FIG. 2). When a radially converging profile is utilized, but the centerline of the secondary fluid channels is not shifted (i.e., if secondary fluid channels 22 are symmetric about first axis $A_1$ within manifold 12), some of the walls of secondary fluid channels 22 can be oriented at less than 45 degrees to the build platform. At angles below the optimal build angle, there can be an increased requirement for internal structural support during an additive manufacturing build to maintain structural integrity of the manifold. However, when centerline S is shifted as described herein, all walls of all secondary fluid channels 22 in radially converging manifold 12 can be oriented at 45 degrees or greater to a horizontal build plane or build platform. The build orientation enabled by radially converging manifold 12 can, thereby, have decreased internal support requirements, and the resulting manifold can have improved efficiency.

Figure 3:
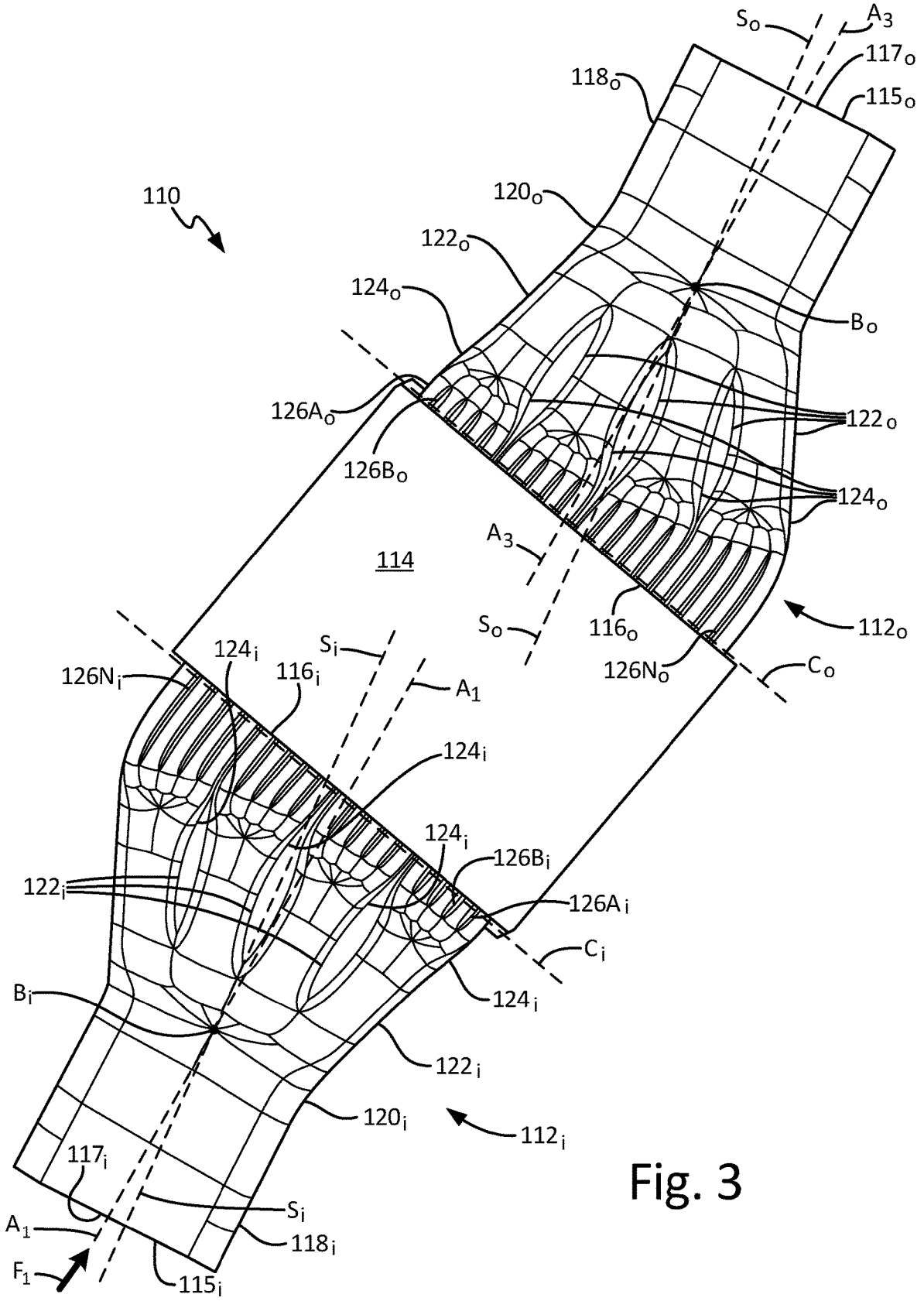
FIG. 3 is a perspective side view of a heat exchanger including an inlet manifold and an outlet manifold.

An embodiment of heat exchanger 110 with inlet manifold $\mathbf{112}_i$ and outlet manifold $\mathbf{112}_o$ is shown in perspective side view in FIG. 3. Heat exchanger 110 is substantially similar to heat exchanger 10, and additionally includes core 114 disposed between fluidly connected inlet manifold $\mathbf{112}_i$ and outlet manifold $\mathbf{112}_o$. Inlet manifold $\mathbf{112}_i$ includes first end $\mathbf{115}_i$, second end $\mathbf{116}_i$, and fluid inlet $\mathbf{117}_i$. Outlet manifold $\mathbf{112}_o$ similarly includes first end $\mathbf{115}_o$, second end $\mathbf{116}_o$, and fluid outlet $\mathbf{117}_o$.

In serial fluid communication with each of fluid inlet $\mathbf{117}_i$ and fluid outlet $\mathbf{117}_o$ (denoted in FIG. 3 with the applicable "i" or "o" subscript, but generally referred to herein solely by reference number) are primary fluid channel 118, first branched region 120, secondary fluid channels 122, second branched regions 124, and tertiary fluid channels 126A-126N. Tertiary fluid channels 126A-126N form interface C between each of inlet manifold $\mathbf{112}_i$ and outlet manifold $\mathbf{112}_o$ and core 114 at second end 116. Each of inlet manifold $\mathbf{112}_i$ and outlet manifold $\mathbf{112}_o$ can include secondary fluid channels 122 with radially converging geometry and shifted centerline S, as described above with reference to FIGS. 1 and 2. Centerline $S_i$ of inlet manifold $\mathbf{112}_i$ and centerline $S_o$ of outlet manifold 112 can be parallel, such that each of secondary fluid channels $\mathbf{122}_i$ corresponds to one of secondary fluid channels $\mathbf{122}_o$ that forms a same angle with a horizontal plane (not shown in FIG. 3). Similarly, as shown in the example of FIG. 3, primary fluid channel $\mathbf{118}_o$ of outlet manifold $\mathbf{112}_o$ can be centered about outlet axis $A_3$, which can be parallel to first axis $A_1$. In other examples, primary fluid channel $\mathbf{118}_o$ of outlet manifold $\mathbf{112}_o$ can also be centered about first axis $A_1$, such that primary fluid channel $\mathbf{118}_o$ of outlet manifold $\mathbf{112}_o$ and primary fluid channel $\mathbf{118}_i$ of inlet manifold $\mathbf{112}_i$ are directly aligned.

In the example of FIG. 3, interface $C_i$ of inlet manifold $\mathbf{112}_i$ and interface $C_o$ of outlet manifold $\mathbf{112}_o$ are parallel along opposite ends of core 114 corresponding to second end $\mathbf{116}_i$ and second end $\mathbf{116}_o$, respectively. It should be understood that because interface $C_i$ and interface $C_o$ depend on the geometry of tertiary fluid channels 126A-126N (as described above with reference to tertiary fluid channels 26A-26N in FIG. 2), inlet manifold $\mathbf{112}_i$ and outlet manifold $\mathbf{112}_o$ can be configured in alternate embodiments such that interface $C_i$ and interface $C_o$ are not parallel. Furthermore, though the example of FIG. 3 shows outlet manifold $\mathbf{112}_o$ mirrors and is slightly offset from inlet manifold $\mathbf{112}_i$ on an opposite side of core 114, it should be understood that in other examples, depending on the geometry of core 114, outlet manifold $\mathbf{112}_o$ can be aligned with inlet manifold $\mathbf{112}_i$. In yet other examples, outlet manifold $\mathbf{112}_o$ can have a different configuration than inlet manifold $\mathbf{112}_i$, such as different levels of branching, different numbers of branches at each branched region, or a different overall geometry.

In a manner that is substantially similar to that described above with reference to FIGS. 1 and 2, heat exchanger 110 is configured to permit the transfer of heat between first fluid $F_1$ and second fluid $F_2$ (FIG. 1). In the example of FIG. 3, first fluid $F_1$ is shown flowing generally along first axis $A_1$ to enter heat exchanger 110 at fluid inlet $\mathbf{117}_i$. First fluid $F_1$ passes through the branching tubular network (primary fluid channel $\mathbf{118}_i$, first branched region $\mathbf{120}_i$, secondary fluid channels $\mathbf{122}_i$, second branched regions $\mathbf{124}_i$, and tertiary fluid channels $\mathbf{126}A_i$-$\mathbf{126}N_i$) of inlet manifold $\mathbf{112}_i$, through core 114, to the branching tubular network (tertiary fluid channels $\mathbf{126}A_o$-$\mathbf{126}N_o$, second branched regions $\mathbf{124}_o$, secondary fluid channels $\mathbf{122}_o$, first branched region $\mathbf{120}_o$, and primary fluid channel $\mathbf{118}_o$) of outlet manifold $\mathbf{112}_o$, and exits heat exchanger 110 at fluid outlet $\mathbf{117}_o$. Heat exchanger 110 is configured such that first fluid $F_1$ encounters the same branching tubular network within outlet manifold $\mathbf{112}_o$ as in inlet manifold $\mathbf{112}_i$ in reverse order. In another example, the direction of flow of first fluid $F_1$ can be reversed such that first fluid $F_1$ enters heat exchanger 110 at fluid outlet $\mathbf{117}_o$ and exits at fluid inlet $\mathbf{117}_i$. Furthermore, heat exchanger 110 can be arranged to receive second fluid $F_2$ (FIG. 1) at core 14 along second axis $A_2$ (FIG. 1) perpendicular to axis $A_1$ (i.e., a cross-flow arrangement as shown in FIG. 1), or to receive second fluid $F_2$ along an axis parallel to axis $A_1$ (not shown in FIG. 1) in an opposite flow direction (i.e., a counter-flow arrangement).

Thus, heat exchanger 110 is configured to facilitate the transfer of heat between first fluid $F_1$ and second fluid $F_2$ (FIG. 1) at core 114. First fluid $F_1$, exiting heat exchanger 110 at fluid outlet $\mathbf{117}_o$, can have a final temperature (e.g., after heat transfer has occurred and equilibrium is reached) that is suitable for cooling and/or lubrication of components in a larger system, such as a gas turbine engine or aerospace system.

Heat exchanger 110 presents the same benefits as described above in relation to heat exchanger 10, including equivalent paths for fluid flow such that there is no path of least resistance and no resulting pressure drop and geometry that enables heat exchanger 110 to be additively manufactured with reduced internal structural support. As shown in FIG. 3, centerline S of secondary fluid channels 122 of both inlet manifold $\mathbf{112}_i$ and outlet manifold $\mathbf{112}_o$ can be shifted such that all walls of secondary fluid channels 122 of heat exchanger 110 can have an optimal build angle of 45 degrees or greater (not shown in FIG. 3) to a horizontal build plane for additive manufacturing. Accordingly, the techniques of this disclosure enable heat exchanger 110 to provide more effective heat transfer by reducing internal structural support requirements.

Discussion of Possible Embodiments

The following are non-exclusive descriptions of possible embodiments of the present invention.

A heat exchanger manifold configured to receive or discharge a first fluid includes a primary fluid channel and a plurality of secondary fluid channels. The primary fluid channel includes a fluid port and a first branched region distal to the fluid port. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end.

The heat exchanger manifold of the preceding paragraph can optionally include, additionally and/or alternatively, any one or more of the following features, configurations and/or additional components:

Each of the plurality of secondary fluid channels can provide an equivalent path for directing fluid flow of the first fluid.

Each of the plurality of secondary fluid channels can be tubular.

The primary fluid channel can be symmetric about a first axis, the plurality of secondary fluid channels can be symmetric about a second axis, and the second axis can form a non-zero angle with the first axis.

The heat exchanger manifold can further include a second branched region adjacent to the second end of each of the plurality of secondary fluid channels, and a plurality of tertiary fluid channels fluidly connected to each of the plurality of secondary channels at the second branched region.

The heat exchanger manifold can have a fractal geometry.

Each of the plurality of secondary fluid channels can be tubular, and each of the plurality of tertiary fluid channels can be tubular.

The heat exchanger manifold can further include a heat exchanger core, wherein the plurality of tertiary fluid channels can be fluidly connected to the heat exchanger core.

The heat exchanger manifold can be additively manufactured at a build angle of 45 degrees or greater to a horizontal plane based on structural support requirements for additive manufacturing.

A heat exchanger includes and inlet manifold configured to receive a first fluid, a core in fluid communication with the inlet manifold, and an outlet manifold in fluid communication with the core. The inlet manifold includes a primary fluid channel and a plurality of secondary fluid channels. The primary fluid channel includes a fluid inlet and a first branched region distal to the fluid inlet. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end. The outlet manifold similarly includes a primary fluid channel and a plurality of secondary fluid channels. The primary fluid channel includes a fluid inlet and a first branched region distal to the fluid inlet. The plurality of secondary fluid channels are fluidly connected to the primary fluid channel at the first branched region. Each of the plurality of secondary fluid channels includes a first end and a second end opposite the first end. Each of the plurality of secondary fluid channels extends radially from the first branched region at the first end and has an equal length from a center of the first branched region to the second end.

The heat exchanger of the preceding paragraph can optionally include, additionally and/or alternatively, any one or more of the following features, configurations and/or additional components:

Each of the plurality of secondary fluid channels of the inlet manifold and of the outlet manifold can provide an equivalent path for directing fluid flow of the first fluid.

Each of the plurality of secondary fluid channels of the inlet manifold and of the outlet manifold can be tubular.

The primary fluid channel of the inlet manifold and of the outlet manifold can be symmetric about a first axis, the plurality of secondary fluid channels of the inlet manifold and of the outlet manifold can be symmetric about a second axis, and the second axis can form a non-zero angle with the first axis.

The heat exchanger can further include a second branched region adjacent to the second end of each of the plurality of secondary fluid channels of the inlet manifold and of the outlet manifold, and a plurality of tertiary fluid channels fluidly connected to each of the plurality of secondary channels of the inlet manifold and of the outlet manifold at the second branched region.

At least one of the inlet manifold and the outlet manifold can have a fractal geometry.

Each of the plurality of secondary fluid channels of the inlet manifold and of the outlet manifold can be tubular, and each of the plurality of tertiary fluid channels of the inlet manifold and of the outlet manifold can be tubular.

The plurality of tertiary fluid channels of the inlet manifold and of the outlet manifold can be fluidly connected to the core.

The inlet manifold and the outlet manifold can be additively manufactured at a build angle of 45 degrees or greater to a horizontal plane based on structural support requirements for additive manufacturing.

A method includes forming a core for a heat exchanger and additively manufacturing a first manifold for the heat exchanger. Additively manufacturing the first manifold includes additively building a branching tubular network. The network includes a primary fluid channel connected to a first branched region, a plurality of secondary fluid channels fluidly connected to the primary fluid channel at the first branched region, a second branched region, and a plurality of tertiary fluid channels fluidly connected to each of the plurality of secondary channels at the second branched region. Each of the plurality of secondary fluid channels includes a first end and a second end opposite the first end, wherein each of the plurality of secondary fluid channels extends radially from the first branched region at the first end and has an equal length from a center of the first branched region to the second end. The second branched region is adjacent to the second end of each of the plurality of secondary fluid channels. The primary fluid channel is symmetric about a first axis, the plurality of secondary fluid channels are symmetric about a second axis, and the second axis forms a non-zero angle with the first axis, such that each of the plurality of secondary fluid channels forms a build angle of 45 degrees or greater with a horizontal plane.

The method of the preceding paragraph can optionally include, additionally and/or alternatively, any one or more of the following features, configurations, operations, and/or additional components:

The build angle can be based on structural support requirements for additive manufacturing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger manifold configured to receive or discharge a first fluid, the manifold comprising:

a primary fluid channel, the primary fluid channel comprising:

a fluid port; and a first branched region distal to the fluid port; and secondary fluid channels with radially equal lengths such that a flow path through each of the secondary fluid channels is equivalent, the secondary fluid channels fluidly connected to the primary fluid channel at the first branched region, each of the secondary fluid channels comprising:

a first end connected to the primary fluid channel; and a second end opposite the first end;

wherein the primary fluid channel is symmetric about a first axis and an arrangement of at least three secondary fluid channels that are spaced along an arc is symmetric about a second common axis that forms a non-zero angle with the first axis.

2. The heat exchanger manifold of claim 1, further comprising:

Tertiary fluid channels fluidly connected to each of the secondary fluid channels at a respective second branched region that is adjacent to the second end of a respective one of the secondary fluid channels to form a consecutively branching structure of the heat exchanger manifold; and wherein each of the secondary fluid channels extends radially from the first branched region such that a respective longitudinal axis of each of the secondary fluid channels converges at a point.

3. The heat exchanger manifold of claim 1, wherein each of the secondary fluid channels extends radially from the first branched region such that a respective longitudinal axis of each of the secondary fluid channels converges at a point.

4. The heat exchanger manifold of claim 1, further comprising:

tertiary fluid channels fluidly connected to each of the secondary fluid channels at a respective second branched region that is adjacent to the second end of a respective one of the secondary fluid channels.

5. The heat exchanger manifold of claim 4, wherein the heat exchanger manifold has a fractal geometry.

6. The heat exchanger manifold of claim 4, wherein each of the secondary fluid channels is tubular, and wherein each of the tertiary fluid channels is tubular.

7. The heat exchanger manifold of claim 4, wherein the tertiary fluid channels are configured to be fluidly connected to a heat exchanger core.

8. The heat exchanger manifold of claim 7, wherein the heat exchanger manifold is configured to be additively manufactured at a build angle of 45 degrees or greater to a horizontal plane based on structural support requirements for additive manufacturing.

9. A heat exchanger comprising:

an inlet manifold configured to receive a first fluid, the inlet manifold comprising:

a primary fluid channel, the primary fluid channel comprising:

a fluid inlet; and a first branched region distal to the fluid inlet; and secondary fluid channels with radially equal lengths such that a flow path through each of the secondary fluid channels is equivalent, the secondary fluid channels fluidly connected to the primary fluid channel at the first branched region, each of the secondary fluid channels comprising:

a first end connected to the primary fluid channel; and a second end opposite the first end;

a core in fluid communication with the inlet manifold; and an outlet manifold in fluid communication with the core, the outlet manifold comprising:

a primary fluid channel, the primary fluid channel comprising:

a fluid outlet; and a first branched region distal to the fluid outlet; and secondary fluid channels with radially equal lengths such that a flow path through each of the secondary fluid channels is equivalent, the secondary fluid channels fluidly connected to the primary fluid channel at the first branched region, each of the secondary fluid channels comprising:

a first end connected to the primary fluid channel; and a second end opposite the first end;

wherein the primary fluid channel of the inlet manifold and of the outlet manifold are each symmetric about a respective first axis and arrangements of at least three secondary fluid channels of the inlet manifold and of the outlet manifold that are spaced along respective arcs are each symmetric about a respective second common axis that forms a non-zero angle with the corresponding first axis.

10. The heat exchanger of claim 9, further comprising:

tertiary fluid channels fluidly connected to each of the secondary fluid channels of the inlet manifold and the outlet manifold at a respective second branched region that is adjacent to the second end of a respective one of the secondary fluid channels to form consecutively branching structures of the inlet manifold and the outlet manifold;

wherein each of the secondary fluid channels of the inlet manifold extends radially from the first branched region of the inlet manifold such that a respective longitudinal axis of each of the secondary fluid channels of the inlet manifold converges at a first point; and wherein each of the secondary fluid channels of the outlet manifold extends radially from the first branched region of the outlet manifold such that a respective longitudinal axis of each of the secondary fluid channels of the outlet manifold converges at a second point.

11. The heat exchanger of claim 9, wherein each of the secondary fluid channels of the inlet manifold extends radially from the first branched region of the inlet manifold such that a respective longitudinal axis of each of the secondary fluid channels of the inlet manifold converges at a first point; and wherein each of the secondary fluid channels of the outlet manifold extends radially from the first branched region of the outlet manifold such that a respective longitudinal axis of each of the secondary fluid channels of the outlet manifold converges at a second point.

12. The heat exchanger of claim 9, further comprising:

tertiary fluid channels fluidly connected to each of the secondary fluid channels of the inlet manifold and the outlet manifold at a respective second branched region that is adjacent to the second end of a respective one of the secondary fluid channels.

13. The heat exchanger of claim 12, wherein at least one of the inlet manifold and the outlet manifold has a fractal geometry.

14. The heat exchanger of claim 12, wherein each of the secondary fluid channels of the inlet manifold and the outlet manifold is tubular, and wherein each of the tertiary fluid channels of the inlet manifold and of the outlet manifold is tubular.

15. The heat exchanger of claim 12, wherein the tertiary fluid channels of the inlet manifold and the outlet manifold are fluidly connected to the core.

16. The heat exchanger of claim 15, wherein the inlet manifold and the outlet manifold are configured to be additively manufactured at a build angle of 45 degrees or greater to a horizontal plane based on structural support requirements for additive manufacturing.

17. A method of additively manufacturing a heat exchanger, the method comprising:

forming a core of the heat exchanger;

additively building a branching tubular network of a first manifold of the heat exchanger, the branching tubular network comprising:

a primary fluid channel connected to a first branched region;

secondary fluid channels with radially equal lengths such that a flow path through each of the secondary fluid channels is equivalent, the secondary fluid channels fluidly connected to the primary fluid channel at the first branched region, each of the secondary fluid channels comprising:

a first end connected to the primary fluid channel; and a second end opposite the first end; and tertiary fluid channels fluidly connected to each of the secondary channels at a respective second branched region that is adjacent to the second end of a respective one of the secondary fluid channels;

wherein the primary fluid channel is symmetric about a first axis, an arrangement of at least three secondary fluid channels that are spaced along an arc is symmetric about a second common axis, and the second common axis forms a non-zero angle with the first axis.

18. The method of claim 17, wherein each of the secondary fluid channels extends radially from the first branched region such that a respective longitudinal axis of each of the secondary fluid channels converges at a point.

19. The method of claim 17, further comprising:

orienting the branching tubular network such that each of the secondary fluid channels is manufactured at a build angle of 45 degrees or greater with a horizontal plane.

20. The method of claim 19, wherein the build angle is based on structural support requirements for additive manufacturing.

* * * * *